US008978569B2

(12) United States Patent
Schmidt

(10) Patent No.: US 8,978,569 B2
(45) Date of Patent: Mar. 17, 2015

(54) HATCH OF A SHIP

(75) Inventor: Hans-Erhard Schmidt, Melbeck (DE)

(73) Assignee: Siemens Aktiengesellschaft, Munich (DE)

( * ) Notice: Subject to any disclaimer, the term of this patent is extended or adjusted under 35 U.S.C. 154(b) by 163 days.

(21) Appl. No.: 13/695,114

(22) PCT Filed: Apr. 21, 2011

(86) PCT No.: PCT/EP2011/056424

§ 371 (c)(1),
(2), (4) Date: Dec. 4, 2012

(87) PCT Pub. No.: WO2011/134888

PCT Pub. Date: Nov. 3, 2011

(65) Prior Publication Data

US 2013/0220198 A1 Aug. 29, 2013

(30) Foreign Application Priority Data

Apr. 30, 2010 (DE) ..... 10 2010 019 658

(51) Int. Cl.

| | |
|---|---|
| ***B63B 19/14*** | (2006.01) |
| ***B63B 3/54*** | (2006.01) |
| ***B63J 99/00*** | (2009.01) |
| *B63J 3/04* | (2006.01) |

(52) U.S. Cl.

CPC . *B63B 3/54* (2013.01); *B63J 99/00* (2013.01); *B63J 2003/043* (2013.01)

USPC ..... 114/201 R

(58) Field of Classification Search

USPC ..... 114/201 R

IPC ..... B63B 19/14

See application file for complete search history.

(56) References Cited

U.S. PATENT DOCUMENTS

| | | | | |
|---|---|---|---|---|
| 3,279,413 | A | 10/1966 | Ellis | |
| 3,604,381 | A * | 9/1971 | Neidenberg | 114/382 |
| 4,853,500 | A * | 8/1989 | Tydlacka | 191/12 R |
| 5,034,571 | A | 7/1991 | Galloway | |
| 5,235,138 | A | 8/1993 | Shah et al. | |
| 6,149,096 | A * | 11/2000 | Hartley | 242/390.9 |
| 7,451,717 | B1 * | 11/2008 | Levine et al. | 114/227 |
| 7,510,136 | B2 | 3/2009 | Popesco | |
| 7,967,120 | B2 | 6/2011 | Popesco | |

(Continued)

FOREIGN PATENT DOCUMENTS

| | | | |
|---|---|---|---|
| CN | 101073187 | A | 11/2007 |
| CN | 101506030 | A | 8/2009 |

(Continued)

OTHER PUBLICATIONS

Siemens AG, Energy Sector, Erlangen, DE; Landstromversorgung / Shoreside power supply published in 2008; 12 pages; www.siemens.com/energy; Others; 2008; DE.

(Continued)

*Primary Examiner* — Stephen Avila

(74) *Attorney, Agent, or Firm* — Laurence A. Greenberg; Werner H. Stemer; Ralph E. Locher

(57) ABSTRACT

A hatch for an outer wall or skin of a ship includes a guide device for guiding a flexible electrical line through the hatch to provide the ship with electrical power. A ship having such a hatch is also provided.

7 Claims, 5 Drawing Sheets

(56) References Cited

U.S. PATENT DOCUMENTS

| | | | |
|---|---|---|---|
| 8,122,841 | B2 | 2/2012 | Feger |
| 2011/0041751 | A1 | 2/2011 | Overa et al. |
| 2012/0111681 | A1 | 5/2012 | Feger |

FOREIGN PATENT DOCUMENTS

| | | | |
|---|---|---|---|
| DE | 20100148 | U1 | 6/2001 |
| EP | 1122164 | A2 | 8/2001 |
| EP | 1667301 | A1 | 6/2006 |
| GB | 1180600 | A | 2/1970 |
| KR | 100572403 | B1 | 4/2006 |
| KR | 200430864 | Y1 | 11/2006 |
| WO | 2007107673 | A1 | 9/2007 |
| WO | 2010139870 | A1 | 12/2010 |

OTHER PUBLICATIONS

International Search Report Dated Jul. 29, 2011.

* cited by examiner

HATCH OF A SHIP

BACKGROUND OF THE INVENTION

Field of the Invention

The electric current required on board ships docked in harbors is usually generated by on-board diesel engine generator units. During the operation of said diesel engine generator units, not inconsiderable amounts of diesel exhaust gases are generated and these include carbon dioxide and nitrogen oxides among other things which are ecologically harmful.

Currently there are thoughts of supplying a ship docked in harbor with electric current from onshore (onshore power supply) by means of a flexible power supply line, a so-called cable line. Said electric current is provided by means of an electric power supply network arranged in the harbor and is transferred to the ship by means of the cable line. In this case, it is conceivable to place the cable line over a randomly selected position on the outer skin of the ship (ship's side). However, this could damage the cable line. In addition, such cable lines placed randomly over the side of the ship provide a source of accident (risk of stumbling etc.).

BRIEF SUMMARY OF THE INVENTION

The object underlying the invention is to provide a device with which a cable line can be brought onto the ship in a secure and ordered manner.

This object is achieved in the invention by a hatch. In an advantageous manner, said hatch has a guide device for an outer skin of a ship for guiding an electric cable line through the hatch, the cable line being provided to supply the ship with electric power. Said guide device guides the electric cable line through the hatch, i.e. from outside the ship into the interior of the ship or vice versa. The cable line is therefore guided through a certain hatch of the ship by means of the guide device. As a result, the position on the ship at which the cable line enters or exits the interior of the ship is precisely established. It is possible for said position to be secured in a corresponding manner by a corresponding sign or other protective measures (such as, for example, protective fences or protective barriers). Said hatch, consequently, makes it possible for the cable line to enter the interior of the ship, i.e. the inner region of the ship, in a secure and ordered manner. In addition, damage to the cable line, which could occur, e.g. caused by sharp burrs or post positions on the side of the ship when the cable line is placed over a randomly chosen position on the side of the ship, is avoided in an advantageous manner.

The hatch as claimed in the invention can be developed such that the guide device has a curvature, by means of which a bending of a guided cable line is definable. The achievement of a guide device curved in such a manner is that a maximum curvature of the guided cable line corresponds to the curvature of the guide device. As a result, the maximum curvature of the cable line is limited to a maximum value. Damage to the cable line by kinking too sharply is avoided in this manner.

The hatch can also be developed in such a manner that the guide device has a trough-shaped portion for accommodating the cable line, wherein the trough-shaped portion has a curvature, by means of which a bending of a guided cable line is definable. By means of said trough-shaped portion, the cable line can be guided through the hatch into the interior of the ship in a particularly secure manner and protected against slipping. The curvature of the trough-shaped portion defines the bend of the guided cable line. This ensures that the cable line in the guided state is not damaged by too strong a kink.

The hatch can also be developed in such a manner that a fastening device for (inextensibly) fastening the cable line is arranged on the guide device. By means of said fastening device, the cable line can be connected in an inextensible manner to the ship. This means that the cable line and the ship form one mechanical unit. This makes it possible to moor the ship securely in the harbor even in a strong wind or a heavy swell.

In addition, the hatch can be developed such that the hatch has a hatch opening and the guide device can be swiveled through the hatch opening. It is particularly advantageous, in this case, that the guide device is arranged so as to be able to be swiveled through the hatch opening. This means that, in an advantageous manner, when it is not being used, the guide device can be swiveled out of the hatch opening, as a result of which the hatch is able to be used for other purposes.

The hatch can also be developed such that the guide device is pivotable between two end positions, wherein the guide device is situated on one side of the hatch opening in the first end position and wherein the guide device reaches through the hatch opening in the second end position. In the case of said development, in an advantageous manner there are two defined end positions: In the first end position, the guide device, for example when it is not being used, is situated on one side of the hatch opening (preferably in the interior of the ship). In said first end position, the hatch opening is released, as a result of which the hatch remains usable for other purposes. In addition, in the first end position the guide device is protected from damage, for example when the ship is undertaking docking maneuvers. In the second end position, the guide device reaches through the hatch opening and is ready to guide the cable line. Said second end position is preferably not assumed until the ship has been made fast securely in the harbor.

The hatch can also be developed such that the hatch has a hatch cover, by means of which the hatch opening is closable when the guide device is situated in the first end position. By means of said hatch cover, the hatch can be closed in an advantageous manner when the guide device is situated in the first end position. This means that the ingress of water into the interior of the ship is prevented, for example, at sea.

The hatch can also be developed such that the hatch has a holding device and the guide device is pivotably connected to said holding device. Said holding device makes it possible for the guide device to pivot between the first end position and the second end position.

The above-mentioned object is also achieved by a ship with a hatch according to the invention.

BRIEF DESCRIPTION OF THE SEVERAL VIEWS OF THE DRAWING

The invention is explained below by way of an exemplary embodiment, in which, in detail.

DESCRIPTION OF THE INVENTION

Figure 1:
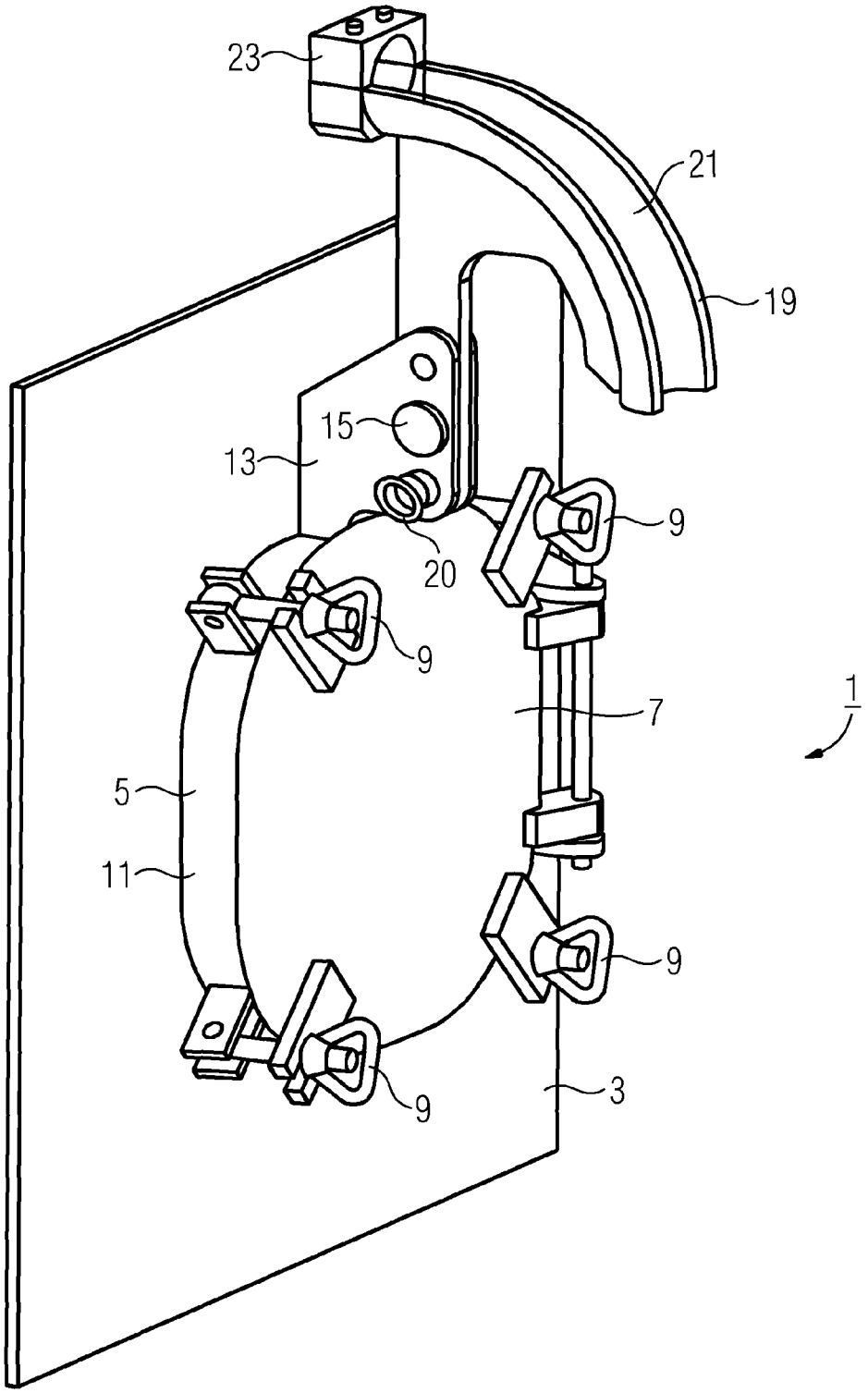
FIG. 1 shows a hatch provided for incorporation into a skin of a ship, said hatch being in the closed state.

FIG. 1 shows a hatch 1 which is provided for insertion into an outer skin (outer side) of a ship. Said hatch has a mounting plate 3 which is inserted (e.g. welded) into an opening in the outer skin of the ship. The hatch 1 also has a hatch opening 5 which is closable by means of a hatch cover 7. In the exemplary embodiment in FIG. 1, said hatch cover 7 is closed in a water-tight manner by means of hatch closures 9. In said exemplary embodiment the hatch closures are realized as tommy screws. The hatch opening 5 is surrounded by a hatch edging 11 which is also designated as hatch coaming. A holding device 13, which accommodates a bolt 15 of a hinge, is connected to the hatch edging 11. A guide device 19, which is provided for guiding an electric cable line, is pivotably connected by means of said hinge. An electric cable line is a flexible (in particular highly flexible) cable. Such a cable line can, for example, have a diameter of approximately 70 mm. The electric cable line, which is guided through the outer skin of the ship by means of a guide device, can preferably be a medium high voltage line which serves to connect the ship to the onshore medium high voltage network. For example, currents within the range of up to 500 A and voltages of up to 11 kV are able to be transferred by means of such a cable line.

In FIG. 1, the guide device 19 is pivoted into a first end position and is secured in said first end position by means of a securing device 20 (which is realized as locking pin 20). In said first end position, the guide device 19 is situated completely on one side of the hatch or of the hatch opening 5, namely in the interior of the ship. The guide device 19 has a trough-shaped portion 21 (half shell 21) which is realized for the accommodation of the cable line. For this purpose, the recess of the trough-shaped portion has a size or a form which is adapted to the cross section of the cable line to be guided. In addition, the trough-shaped portion 21 of the guide device 19 has a curvature which defines the bending of the guided cable line to a maximum value, i.e. the bending radius of the cable line is limited to a minimum value. This means that damage caused by the guided cable line kinking too strongly or sharply is prevented.

In addition, the guide device 19 has a fastening device 23 and the guided cable line is fastened on said fastening device. In the exemplary embodiment said fastening device consists of two half shells which can be clamped against one another by means of threaded bolts, which clamp the guided cable line between them and consequently ensure that the ship and the cable line are connected to form one sturdy unit. Said fastening device 23 makes it possible to relieve the strain on the cable. By means of said fastening device 23, the ship and the cable line become one mechanically fixed system. A tidal lift, generated where applicable by the tides, i.e. a vertical movement of the ship at the quay wall, is balanced out on the onshore side by a corresponding slackening or tightening of the cable line, for example by means of an onshore cable supply system.

Figure 2:
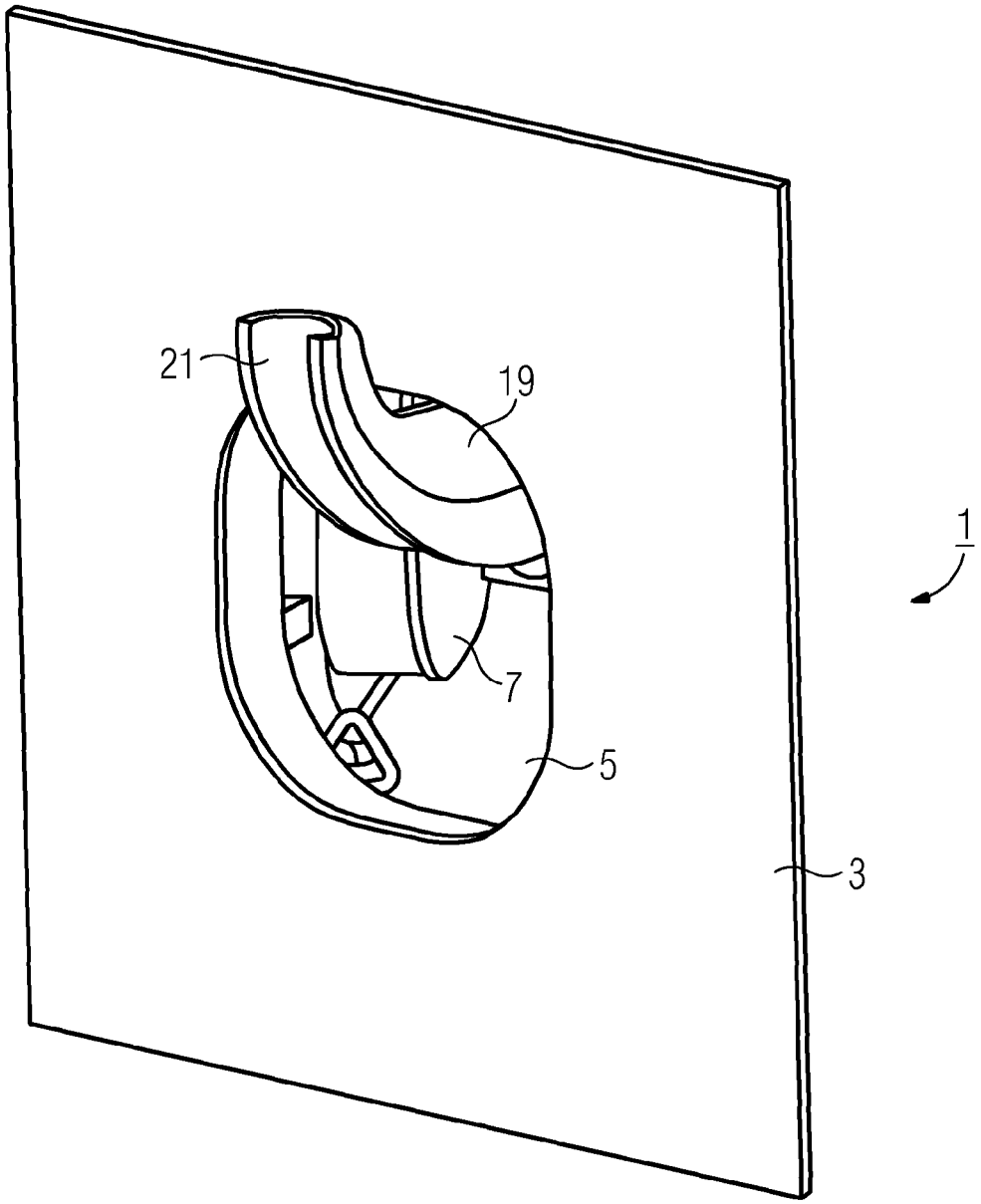
FIG. 2 shows the hatch in the open state, when seen from the outside of the ship.
Figure 3:
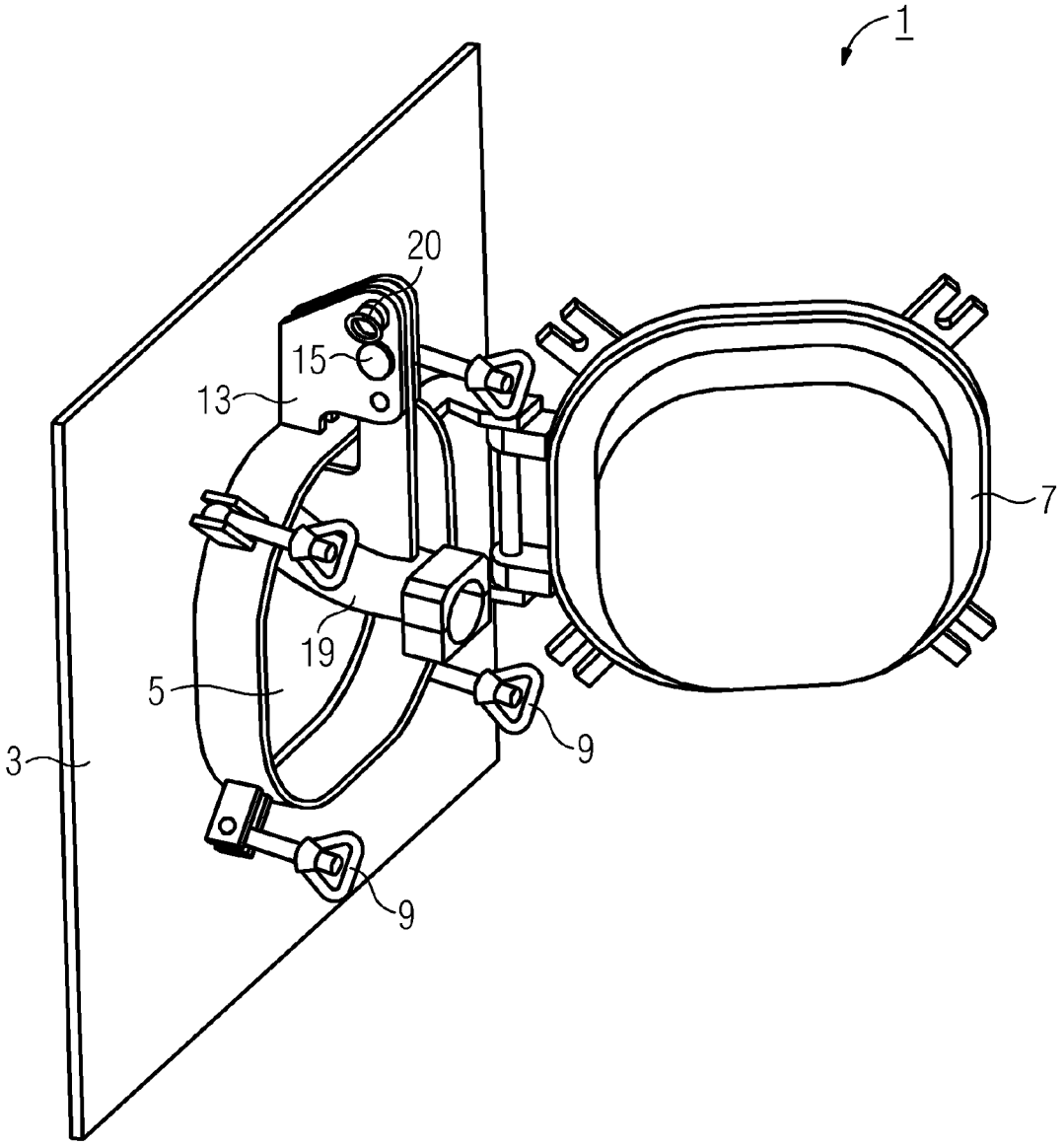
FIG. 3 shows the hatch in the open state, when seen from the interior of the ship.

In FIGS. 2 and 3, the hatch is shown with an open hatch cover 7. The guide device 19 is swiveled through the hatch opening 5 and reaches through said hatch opening. The guide device 19 is situated in its second end position and is secured in said second end position by means of the securing device 20. Part of the guide device 19 is situated on the one side of the hatch or of the hatch opening, e.g. in the interior of the ship. Said part can be seen particularly well in FIG. 3. The other part of the guide device 19 is situated on the other side of the hatch or of the hatch opening, e.g. outside the ship. Said part of the guide device 19 which is situated outside the ship can be seen particularly well in FIG. 2.

Figure 4:
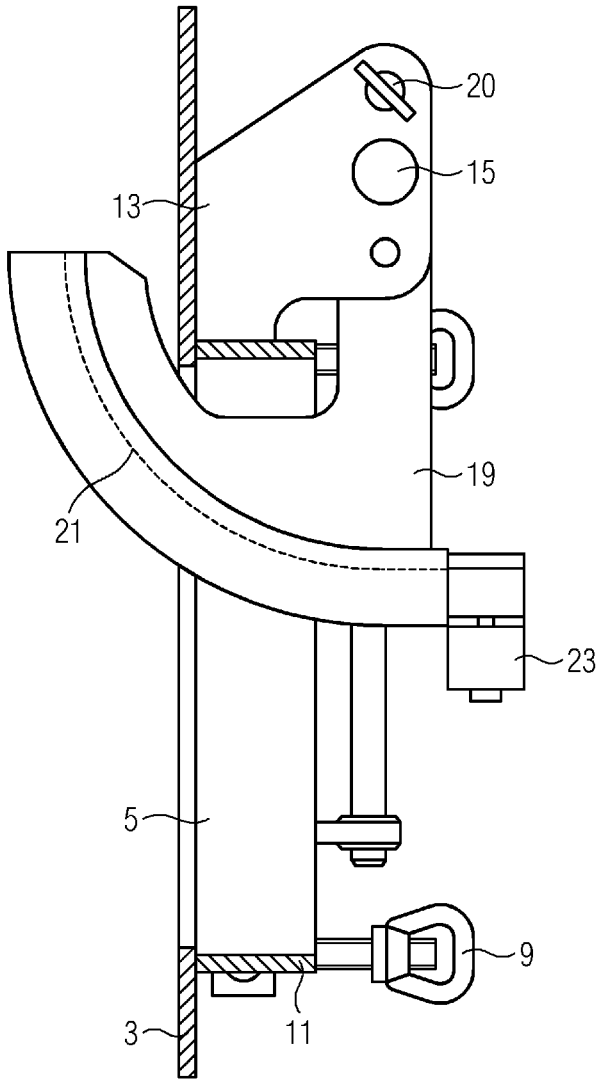
FIG. 4 shows a sectioned view of the hatch and FIG. 5 shows a sectioned view of a ship made fast in the harbor.

FIG. 4 shows a section through the hatch with the guide device in the second end position. It can clearly be seen in this connection that the hatch 1 provides a unit which has the mounting plate 3, the hatch edging 11, the holding device 13, the guide device 19, the fastening device 23 and the hatch closures 9. In addition, the hatch 1 also has the hatch cover 7, which is not shown in FIG. 4, however, for reasons of clarity. Said hatch unit 1 can be prefabricated and is welded into the outer skin 36 of the ship (cf. FIG. 5) for example in a shipyard as a complete unit. Rapid, cost-efficient mounting is possible as a result.

It is pointed out that the usual site of installation of the hatch 1 is shown in FIGS. 1 to 4. This means that, in its second end position, the trough-shaped, curved portion 21 of the guide device 19 is curved upward (that is to say away from the center of the earth) outside the ship. This type of curvature makes it possible in an advantageous manner to guide the cable line upward outside the ship. For example, the cable line can be brought onto the ship by a crane standing on the quay wall.

Figure 5:
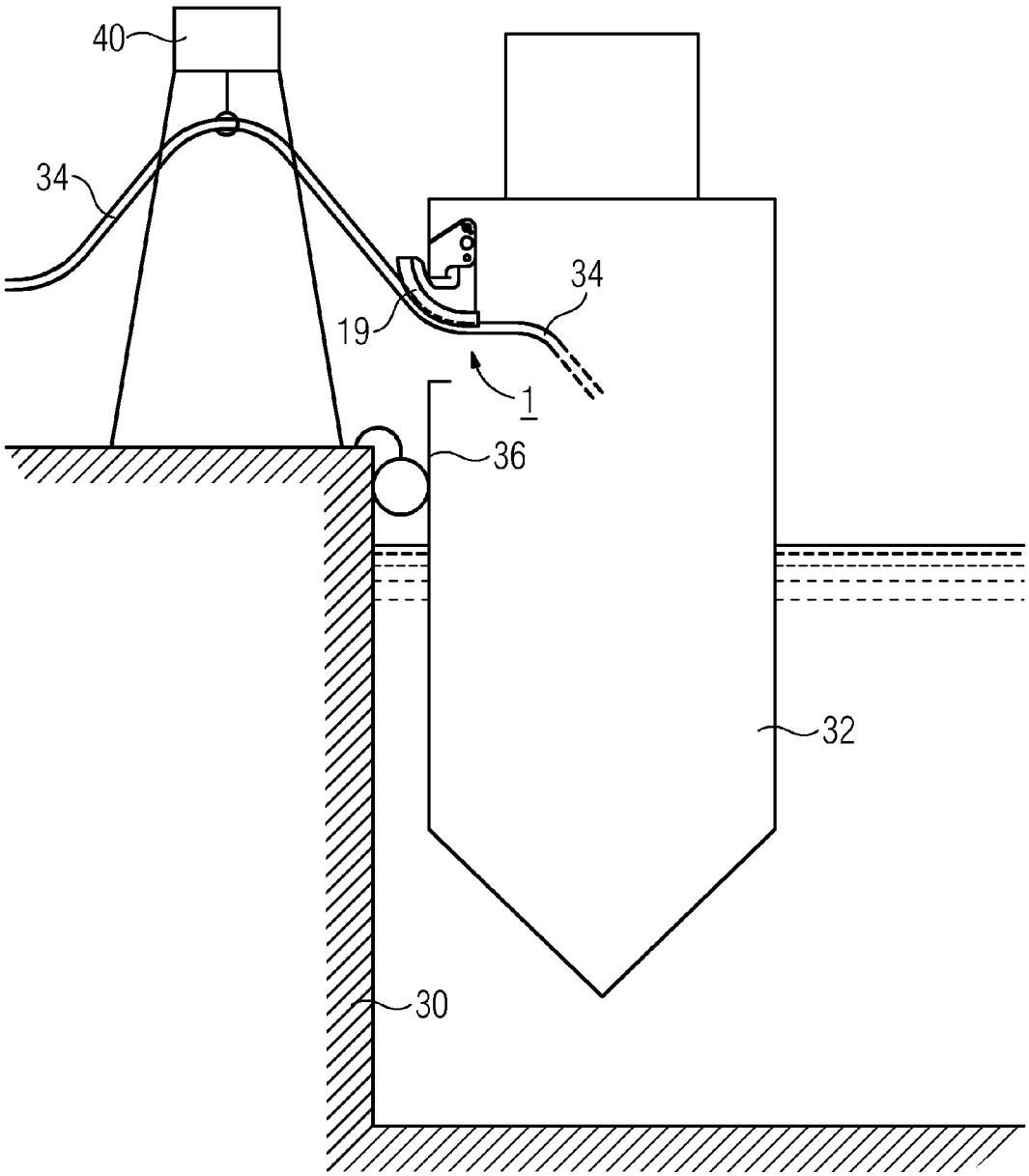

FIG. 5 shows a schematic representation of a ship 32 lying moored at a quay wall 30 in a harbor, said ship being connected to an onshore medium high voltage network for the purposes of supplying onshore current by means of an electric cable line 34. The hatch 1 is welded in the outer skin 36 of the ship 32. The guide device 19 is essentially the only thing to be seen of said hatch. The guide device 19 guides the cable line 34 from outside the ship into the interior of the ship or from the interior of the ship to outside the ship. Outside the ship, the electric cable line is guided upward away from the ship and is held, for example by means of a holding crane 40 which stands on the quay wall 30.

The exemplary embodiment has described a hatch, by means of which one single electric cable line can be guided through the outer skin of the ship. However, a hatch of this type can also be provided with several guide devices of the same type, by means of which several electric cable lines can be guided through the outer skin of the ship. As an example, one or several further similarly constructed guide devices can be arranged to the side next to the guide device 19 shown in the figures, said guide devices being able to be swiveled through the hatch opening parallel to the guide device shown. The hatch can also be provided with an electric sensor which, once the onshore current supply has been disconnected, the electric cable line removed and the guide device 19 pivoted into the first end position, detects the closing of the hatch cover 7 and generates a corresponding signal. In addition, ingressing moisture can be detected by means of a sensor arranged in the interior of the ship in the vicinity of the hatch, whereupon a corresponding alarm signal is generated.

A hatch for an outer skin of a ship and a ship have been described, in the case of which an electric cable line, which is provided for supplying power to the ship, can be guided, in a secure manner and protected from damage, through the outer skin of the ship into the interior of the ship.

The invention claimed is:

1. A hatch for an outer skin of a ship, the hatch comprising:

a guide device disposed at the outer skin of the ship and configured to contact and guide an electric cable line through an opening in the hatch for supplying the ship with electric power;

said guide device configured to swivel through said hatch opening between end positions;

said guide device being partly on one side of said opening and partly on the other side of said opening in one of said end positions; and said guide device having an elongated trough-shaped portion extending partly through said opening when said guide is in said one end position for accommodating the cable line, and said elongated trough-shaped portion having a curvature configured to define a bending of the cable line guided by said guide device.

2. The hatch according to claim 1, wherein said guide device has a curvature configured to define a bending of the cable line guided by said guide device.

3. The hatch according to claim 1, which further comprises a fastening device disposed on said guide device and configured to fasten the cable line.

4. The hatch according to claim 1, which further comprises a hatch cover configured to close said hatch opening when said guide device is situated in said first end position.

5. The hatch according to claim 1, which further comprises a holding device to which said guide device is pivotably connected.

6. A ship, comprising:

a hatch according to claim 1.

7. The hatch according to claim 1, wherein said guide device is configured to remain in contact with the electric cable line in said one end position.

* * * * *